US007065793B1

(12) United States Patent
Wooten

(10) Patent No.: US 7,065,793 B1
(45) Date of Patent: Jun. 27, 2006

(54) CAMOUFLAGING APPARATUS

(76) Inventor: Don K. Wooten, 224 Wooten Rd., Grant, AL (US) 35742

( * ) Notice: Subject to any disclaimer, the term of this patent is extended or adjusted under 35 U.S.C. 154(b) by 88 days.

(21) Appl. No.: 10/783,432

(22) Filed: Feb. 23, 2004

(51) Int. Cl.
*A41D 13/00* (2006.01)

(52) U.S. Cl. ..... 2/69; 2/900; 428/919

(58) Field of Classification Search ..... 2/69, 2/69.5, 88, 89, 94, 108, 85, 80, 93, 95, 900, 2/244, 246; 428/919
See application file for complete search history.

(56) References Cited

U.S. PATENT DOCUMENTS 4,249,268 A 2/1981 Berler
4,517,230 A * 5/1985 Crawford ..... 428/17
4,792,471 A * 12/1988 Lee ..... 428/17
5,159,718 A 11/1992 Moyer
5,203,033 A * 4/1993 Sheppard et al. ..... 2/69
5,274,848 A * 1/1994 Shamblin ..... 2/69
5,347,659 A 9/1994 Tibljas
D358,928 S 6/1995 Stagie et al.
D382,219 S * 8/1997 Renfrew ..... D10/109
5,958,526 A * 9/1999 Spickelmire ..... 428/17
6,060,142 A * 5/2000 Rossini ..... 428/52
6,134,718 A * 10/2000 Sesselmann ..... 2/243.1

* cited by examiner

*Primary Examiner*—Gloria M. Hale

(57) ABSTRACT

A camouflaging apparatus includes a body covering for removably positioning on a body. The body covering has an outer surface and includes a pant and shirt combination for removably positioning over the legs. Each of a plurality of flexible panels has a length generally between 2 inches and 5 inches and a height generally between 2 inches and 5 inches. Each of the panels has a first side and a second side wherein each of the first sides is colored. A plurality of couplers removably attaches the panels to the outer surface of the body covering. Each of the panels may be selectively positioned on the outer surface.

14 Claims, 5 Drawing Sheets

FIG.3
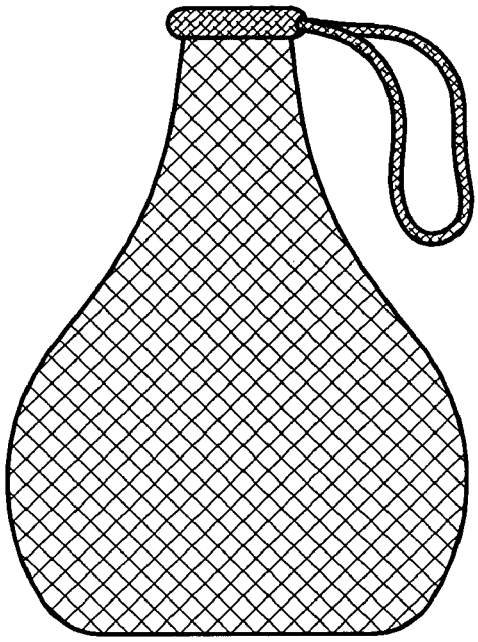
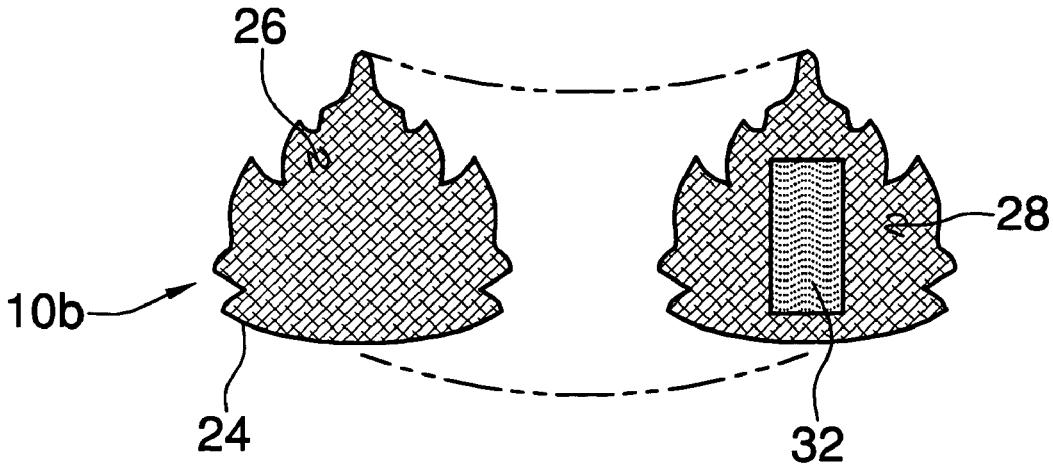
FIG.4

CAMOUFLAGING APPARATUS

BACKGROUND OF THE INVENTION

1. Field of the Invention

The present invention relates to camouflage clothing devices and more particularly pertains to a new camouflage clothing device for providing a camouflaging means for a hunter.

2. Description of the Prior Art

The use of camouflage clothing devices is known in the prior art. U.S. Pat. No. 4,517,230 describes a device that includes elongated strips positioned on an article of the clothing for holding a plurality of artificial leafs. Another type of camouflage clothing device is U.S. Pat. No. 5,274,848 which includes a method of attaching a plurality of filaments to clothing for aiding in the camouflaging of the clothing.

While these devices fulfill their respective, particular objectives and requirements, the need remains for a device that includes a body covering or garment which substantially covers a hunter for camouflaging the hunter's body. The device should include a means for allowing the hunter to determine the amount of camouflage and the color thereof to be positioned on the garment. This will provide more options for the hunter to vary the use of the device and to tailor its use for a variety of environments.

SUMMARY OF THE INVENTION

The present invention meets the needs presented above by providing a body covering garment and couplers for selectively attaching a plurality of flexible panels to the garment. The couplers allow the user of the invention to selectively determine the color, positioning and amount of the panels to be attached to the garment.

To this end, the present invention generally comprises a body covering for removably positioning on a body. The body covering has an outer surface and includes a pant and shirt combination for removably positioning over the legs. Each of a plurality of flexible panels has a length generally between 2 inches and 5 inches and a height generally between 2 inches and 5 inches. Each of the panels has a first side and a second side wherein each of the first sides is colored. A plurality of couplers removably attaches the panels to the outer surface of the body covering. Each of the panels may be selectively positioned on the outer surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic front view of a bag of the present invention.

FIG. 4 is a schematic front and back view of a panel of the present invention.

DESCRIPTION OF THE PREFERRED EMBODIMENT

Figure 1:
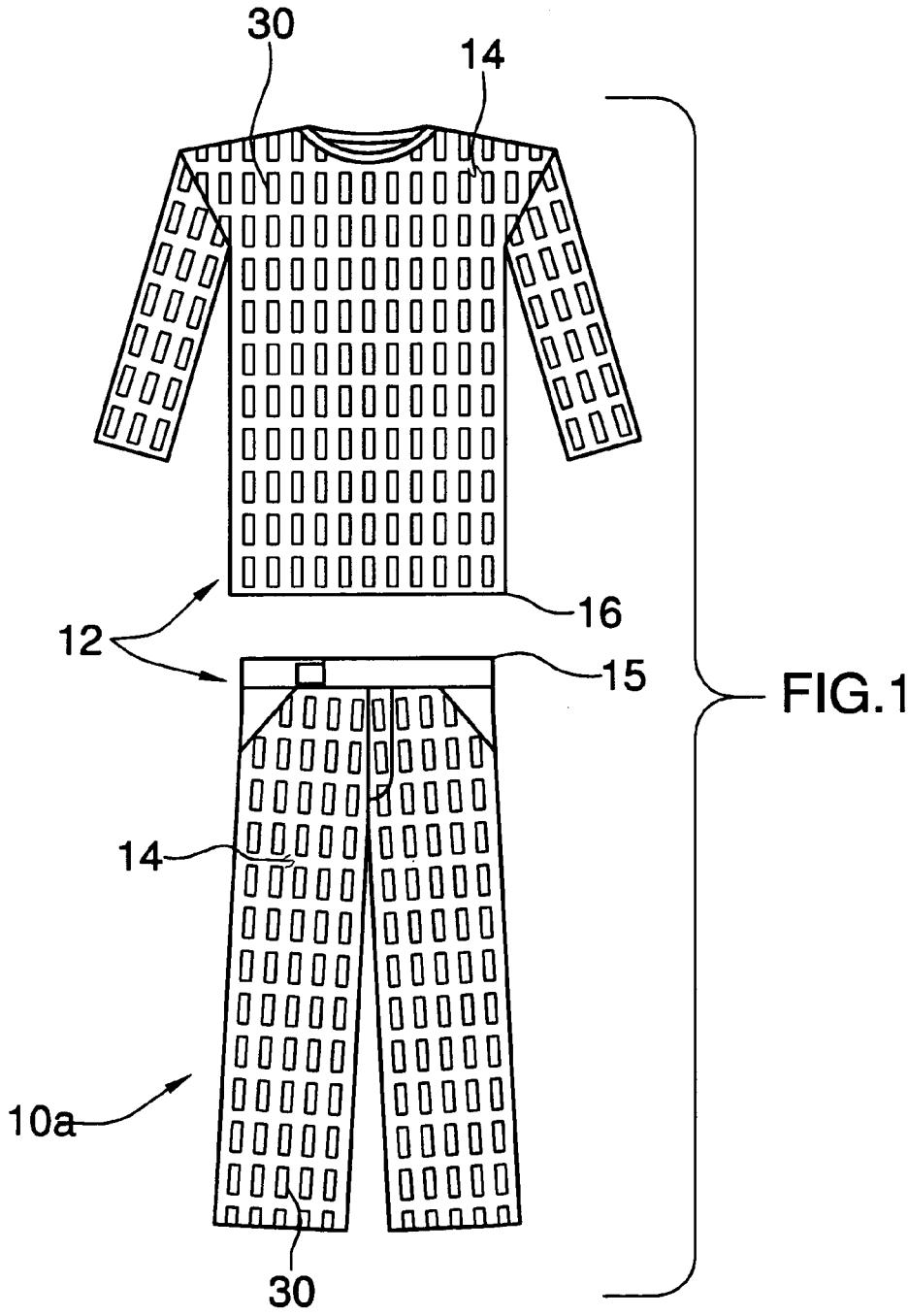
FIG. 1 is a schematic front view of a body covering of a camouflaging apparatus according to the present invention.

With reference now to the drawings, and in particular to FIGS. 1 through 6 thereof, a new camouflage clothing device embodying the principles and concepts of the present invention and generally designated by the reference numeral 10*a* and 10*b* will be described.

Figure 2:
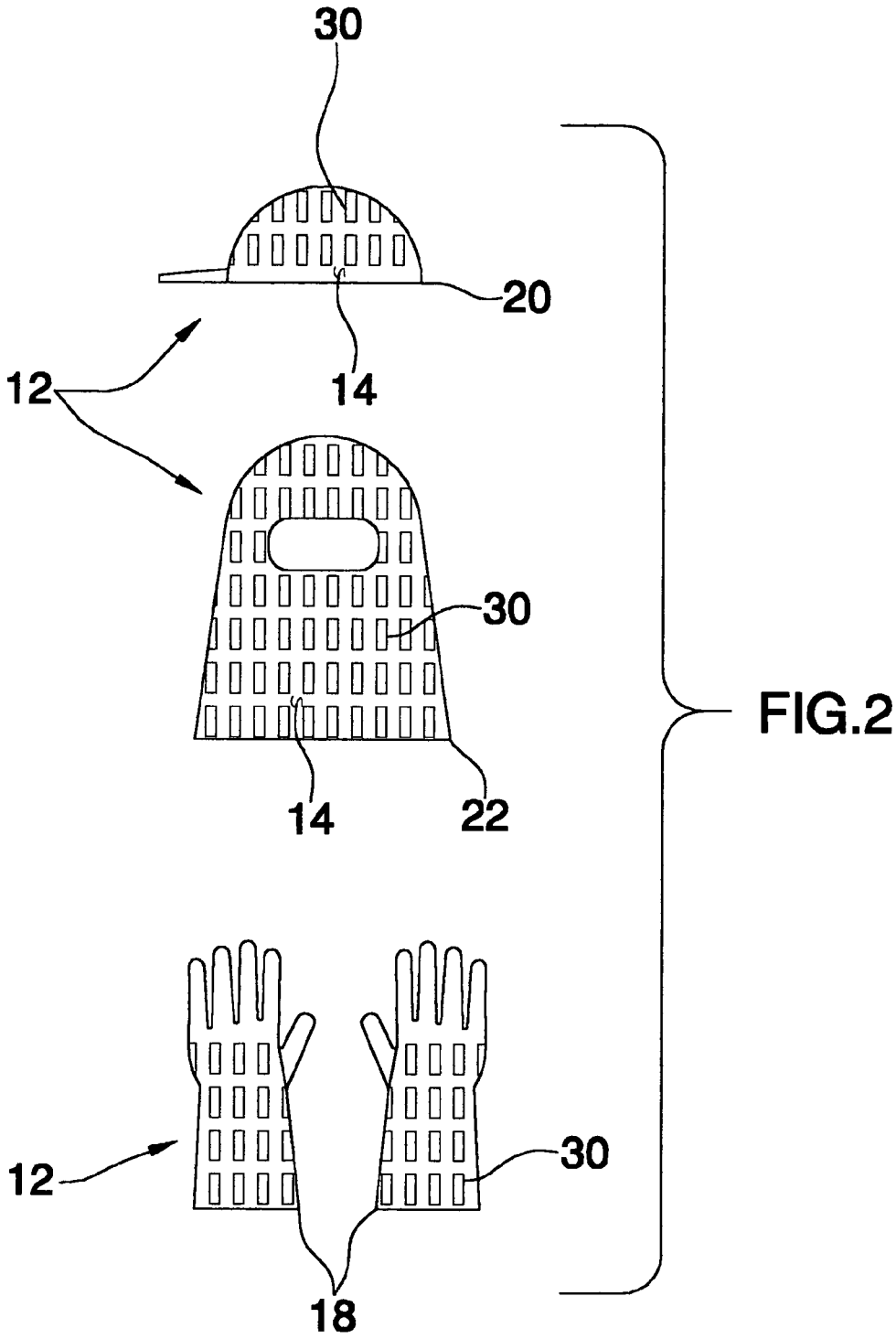
FIG. 2 is a schematic front view of additional portions of the body covering of the present invention.
Figure 5:
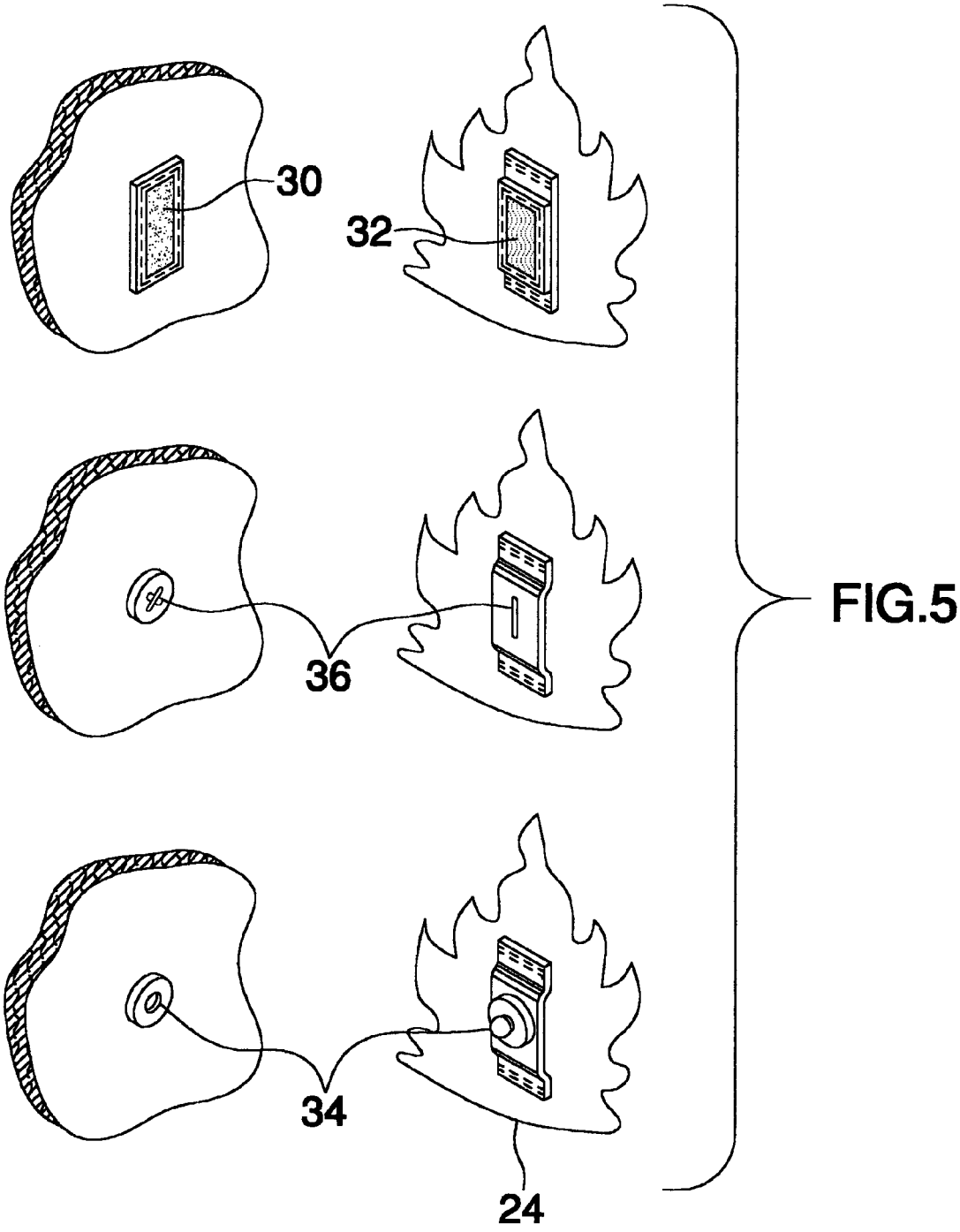
FIG. 5 is a schematic perspective view of couplers of the present invention.
Figure 6:
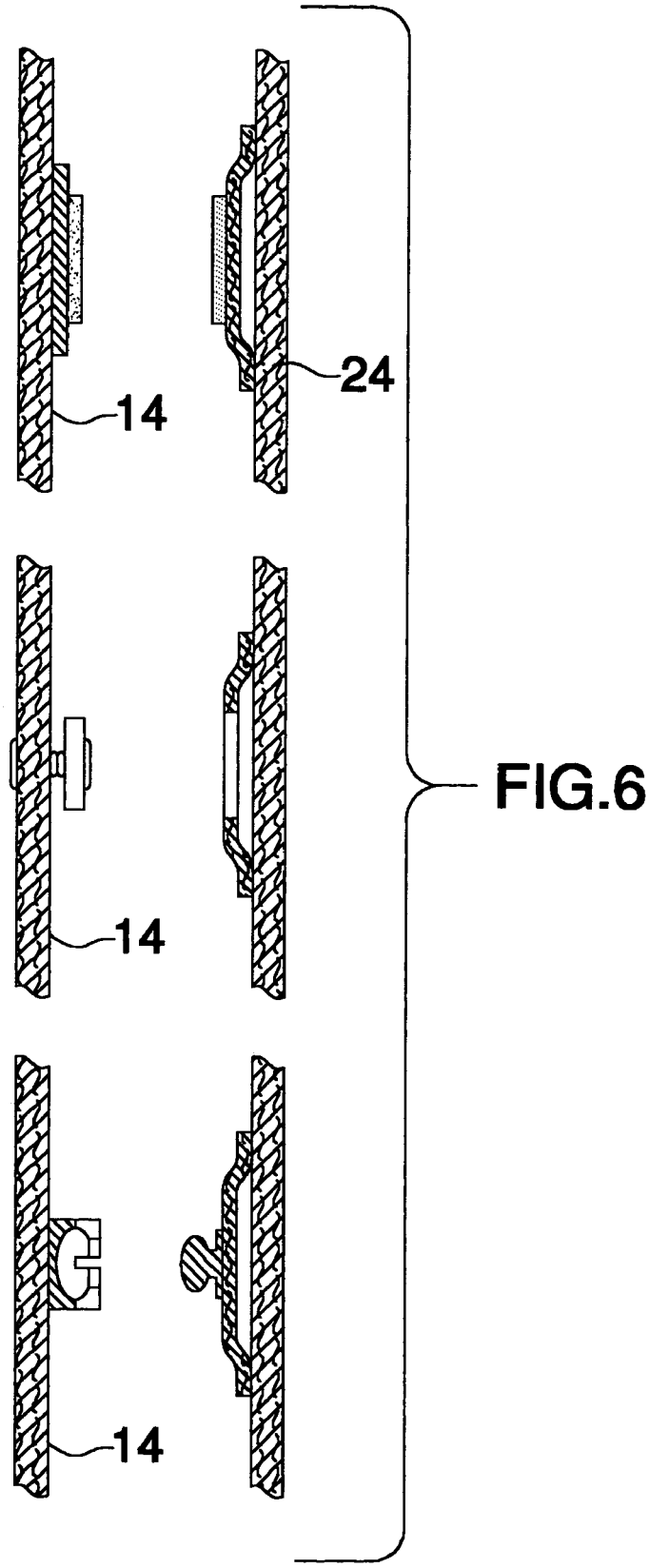
FIG. 6 is a schematic cross-sectional view of couplers of the present invention.

As best illustrated in FIGS. 1 through 6, the camouflaging apparatus 10*a* and 10*b* generally comprises a body covering 12, shown in FIGS. 1 and 2, for removably positioning on the body. The body covering 12 has an outer surface 14. The body covering 12 includes a pant 15 and shirt 16 combination for removably positioning over the legs, body and arms of a hunter. The body covering 12 may also include a pair of gloves 18 for removably positioning over hands, a hat 20 for removably positioning over a head and a face mask 22 for removably positioning over a face. The body covering 12 is comprises of a cloth material and may include any conventional material used for clothing by a hunter and may vary depending on the environment in which the apparatus is to be used.

A plurality of flexible panels 24 is provided. Each of the panels 24 has a length generally between 2 inches and 5 inches and a height generally between 2 inches and 5 inches. The panels 24 each have an irregular shape and, ideally, each of the panels 24 has a shape resembling a leaf. Each of the panels 24 has a first side 26 and a second side 28. Each of the first sides 26 is colored. Preferably, each of the first sides 26 is colored a color selected from the group including shades of yellow, green, red, brown and orange.

A plurality of couplers removably attaches each of the panels 24 to the outer surface 14. Each of the couplers includes a first mating member 30 attached to outer surface 14 of the body covering 12 and a second mating member 32 attached to the second side 28 of the panels 24. The first mating members 30 are spaced from each other and are generally evenly dispersed on the outer surface 14 so that pant 15 and shirt 16 combination, gloves 18, hat 20 and face mask 22 each have a plurality of first mating members 30 thereon. The first 30 and second 32 mating members preferably include a hook and loop fastening means. Other couplers that may be utilized include snap 34 and button 36 couplers.

A mesh container 38 is included for holding the panels 24. The mesh container 38 is preferably water and air permeable so that the panels 24 may be cleansed while being held in the container.

In use, the body covering 12 is positioned over the body of a hunter who wishes to be camouflaged. Each of the panels 24 may be selectively positioned on the outer surface 14 so that the body covering is substantially covered with the panels 24. The panels 24 may be chosen for their color so that the hunter blends into his surrounding while some colors, such as yellow and orange, may be used to visually warn others of the presence of the camouflaged hunter.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body camouflaging assembly consisting of:

a body covering for removably positioning on a body, said body covering having an outer surface, said body covering including a pant and shirt combination for removably positioning over the legs;

a plurality of flexible panels, each of said panels having a length generally between 2 inches and 5 inches and a height generally between 2 inches and 5 inches, each of said panels having a first side and a second side, each of said first sides being colored;

a plurality of couplers for removably attaching said panels to said outer surface; and wherein each of said panels may be selectively positioned on said outer surface.

2. The assembly according to claim 1, wherein said body covering includes a pair of gloves for removably positioning over hands.

3. The assembly according to claim 2, wherein said body covering including a hat for removably positioning over a head.

4. The assembly according to claim 2, wherein said body covering including a face mask for removably positioning over a face.

5. The assembly according to claim 1, wherein said body covering is comprised of a cloth material.

6. The assembly according to claim 1, wherein each of said panels has an irregular shape.

7. The assembly according to claim 6, wherein each of said panels has a shape resembling a leaf.

8. The assembly according to claim 7, wherein each of said first sides is colored a color selected from the group including shades of yellow, green, red, brown and orange.

9. The assembly according to claim 1, wherein each of said first sides is colored a color selected from the group including shades of yellow, green, red, brown and orange.

10. The assembly according to claim 1, wherein each of said couplers includes a first mating member attached to outer surface and a second mating member attached to said second side of sail panels, said first mating members being spaced from each other and being generally evenly dispersed on said outer surface.

11. The assembly according to claim 10, wherein said first and second mating members including a hook and loop fastening means.

12. The assembly according to claim 7, wherein each of said couplers includes a first mating member attached to outer surface and a second mating member attached to said second side of said panels, said first mating members being spaced from each other and being generally evenly dispersed on said outer surface.

13. The assembly according to claim 12, wherein said first and second mating members including a hook and loop fastening means.

14. A body camouflaging assembly consisting of:

a body covering for removably positioning on a body, said body covering having an outer surface, said body covering including a pant and shirt combination for removably positioning over the legs, body and arms, a pair of gloves for removably positioning over hands, a hat for removably positioning over a head and a face mask for removably positioning over a face, said body covering comprising a cloth material;

a plurality of flexible panels, each of said panels having a length generally between 2 inches and 5 inches and a height generally between 2 inches and 5 inches, each of said panels having an irregular shape, each of said panels having a shape resembling a leaf, each of said panels having a first side and a second side, each of said first sides being colored, each of said first sides being colored a color selected from the group including shades of yellow, green, red, brown and orange;

a plurality of couplers for removably attaching said panels to said outer surface, each of said couplers including a first mating member attached to outer surface and a second mating member attached to said second side of said panels, said first mating members being spaced from each other and being generally evenly dispersed on said outer surface, said first and second mating members including a hook and loop fastening means; and wherein each of said panels may be selectively positioned on said outer surface.

* * * * *